US005479918A

United States Patent [19]

Petit

[11] Patent Number: 5,479,918

[45] Date of Patent: Jan. 2, 1996

[54] BREATH CONTROLLER

[76] Inventor: James F. Petit, 1009 W. Weiland Ave., Appleton, Wis. 54914

[21] Appl. No.: 269,135

[22] Filed: Jun. 30, 1994

[51] Int. Cl.[6] ..... A62B 18/08

[52] U.S. Cl. ..... 128/201.15; 128/206.22; 128/201.24

[58] Field of Search ..... 128/201.22–201.25, 128/201.28, 206.15, 206.22, 206.28, 207.12, 201.15, 206.21; 2/4, 9, 410, 424

[56] References Cited

U.S. PATENT DOCUMENTS

| | | | |
|---|---|---|---|
| 1,078,364 | 11/1913 | Longeway | 128/206.28 |
| 1,177,438 | 3/1916 | Newman | 128/206.28 |
| 1,352,818 | 9/1920 | Lamb et al. | 128/201.15 |
| 1,366,392 | 1/1921 | Lamb et al. | 128/201.15 |
| 1,454,645 | 5/1923 | Koehler | 128/207.12 |
| 1,730,227 | 10/1929 | McBride | 128/201.15 |
| 2,353,643 | 7/1944 | Bulbulian | 128/141 |
| 2,684,066 | 7/1954 | Glidden | 128/201.15 |
| 3,052,887 | 9/1962 | Sockel et al. | 2/9 |
| 4,154,235 | 5/1979 | Warncke | 128/201.25 |
| 4,354,285 | 10/1982 | Rudd | 2/424 |
| 4,555,815 | 12/1985 | Walther | 2/424 |
| 4,559,939 | 12/1985 | Levine et al. | 128/201.28 |
| 5,003,632 | 4/1991 | Claude | 2/6 |

FOREIGN PATENT DOCUMENTS

| | | |
|---|---|---|
| 581734 | 8/1959 | Canada . |
| 2595573 | 9/1987 | France . |
| 1576647 | 10/1980 | United Kingdom . |

OTHER PUBLICATIONS

Willson brochure dated Jul. 1986 for 1200 Series Interchangeable Respirator, P.O. Box 622, Reading, Pa. 19603.

*Primary Examiner*—Kimberly L. Asher
*Attorney, Agent, or Firm*—Donald Cayen

[57] ABSTRACT

A breath controller prevents fogging of the face shield of a helmet during cold weather. The breath controller comprises a facepiece that fits comfortably over a person's chin, mouth, and nose. One end of a sleeve is held in a sole opening in the facepiece at the chin section thereof. The sleeve second end terminates well below the lowermost edge of the helmet. The facepiece and sleeve cooperate to direct the person's breath between his nose and mouth and the atmosphere such that no exhaled breath comes in contact with the inside of the helmet. In a modified embodiment of the invention, the sleeve is replaced by a short retainer and a cap that is removably attached to the retainer.

2 Claims, 3 Drawing Sheets

BREATH CONTROLLER

BACKGROUND OF THE INVENTION

1. Field of the Invention

This invention pertains to masks, and more particularly to apparatus for controlling air movement around a person's lace.

2. Description of the Prior Art

It is well known for persons who ride in open vehicles to wear protective helmets. For example, motorcyclists, snowmobilers, and ice boaters normally include helmets as part of their riding equipment. Although helmets are available in many different designs, almost all of them include a transparent shield that covers most or all of the face. Without question, the helmets contribute to the safety of the persons wearing them.

However, under certain circumstances helmets develop a problem that is annoying and even dangerous. That problem concerns the fogging of the face shield. Whenever the outdoor temperature falls below the dew point of the moisture in a person's breath, that moisture condenses on the inside of the face shield. An even bigger problem concerns the fogging of a person's glasses. It is dangerous, of course, to operate a vehicle with a fogged face shield or glasses.

In an attempt to overcome the face shield and glasses fogging problems, which are most acute in the winter months, it is known to design helmets and face shields with ventilation grooves. U.S. Pat. No. 4,354,285 shows such a helmet and face shield. Another solution is to include a breathing mask with a helmet. The breathing mask may be a separate component that is removably attachable to the helmet. U.S. Pat. Nos. 4,555,815 and 5,003,632 and British patent 1,576,647 describe such combination helmets and masks.

Despite the variety of helmets and masks that are presently available, none is completely satisfactory. Some are undesirably expensive, and others are quite cumbersome to use. Consequently, many persons ride in the winter months with their helmet face shields open, thus defeating their purpose by exposing the person to frost bite and watering eyes.

Therefore, a need exists for improvements in controlling air movement inside protective helmets.

SUMMARY OF THE INVENTION

In accordance with the present invention, a breath controller is provided that eliminates fogging of a helmet face shield and a person's glasses due to condensation of the person's breath. This is accomplished by apparatus that directs the flow of breath exhaled by the person to a location remote from the helmet.

The breath controller is comprised of a flexible facepiece in the form of a shell that is made from a soft and flexible material. The facepiece shell has a free edge with a generally pear-shaped contour that fits snugly but comfortably around a person's nose, mouth, and chin. The chin section of the facepiece shell is formed with a short tube. One end of a rigid sleeve is held in the shell tube. The sleeve extends outwardly and downwardly away from the shell chin section and terminates in a rather large end opening. Around the wall of the sleeve are formed several smaller transverse holes.

The breath controller is held to a person's head by adjustable straps that are secured to the facepiece. The tube of the facepiece shell and the sleeve are designed such that the sleeve end opening and transverse holes are substantially below the lowermost edge of a protective helmet worn by a person.

In use, the breadth controller is completely independent of any helmet worn by a person. The breath controller shell does not interfere in any way with either the face shield of the helmet or with putting on or taking off the helmet.

The sleeve directs the person's exhaled breath away from the inside of the helmet such that the breath is exhaled directly to the atmosphere outside the helmet. As a result, moisture in the breath has no opportunity to condense inside the helmet. Consequently, the face shield and the person's glasses always stay clear of condensed moisture, even on the coldest days and even when the person is not moving. The multiple transverse holes in the sleeve greatly increase the likelihood that at least one hole will remain open if the person tilts his head downwardly in a manner that presses the sleeve against clothing on his chest.

In an alternate construction, the breath controller sleeve is replaced by a short hollow retainer and a cap. In that design, one end of the retainer is held in the tube of the facepiece shell. The cap is removably attached at one end thereof to the second end of the retainer. The cap is formed with an annular wall that terminates in a large end opening. Several smaller transverse holes are formed in the cap wall. When worn with a helmet, the cap end opening and the transverse holes are well below the lowermost portion of the helmet.

The apparatus and method of the invention, using a sleeve that projects lower than the lowermost portion of a helmet and face shield, thus positively directs air exhaled by a person to outside of a helmet and face shield worn by the person. The probability of the face shield or a person's glasses becoming fogged is remote, even though there is minimal air circulation inside the helmet and face shield.

Other advantages, benefits, and features of the invention will become apparent to those skilled in the art upon reading the detailed description of the invention.

DETAILED DESCRIPTION OF THE PREFERRED EMBODIMENT

Figure 1:
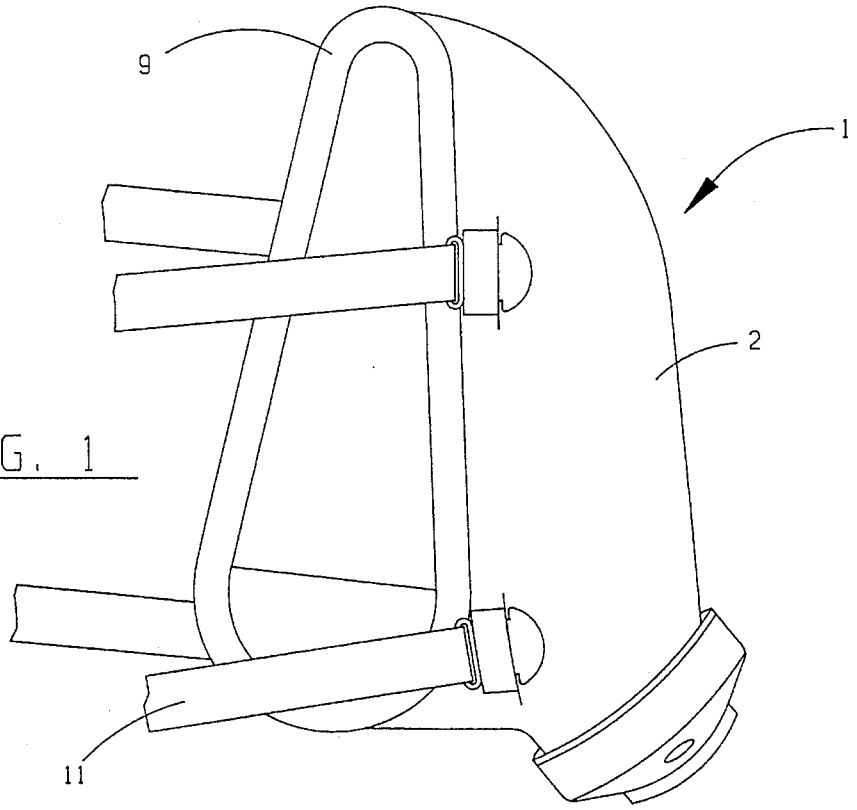
FIG. 1 is a perspective view of the breath controller of the present invention.
Figure 2:
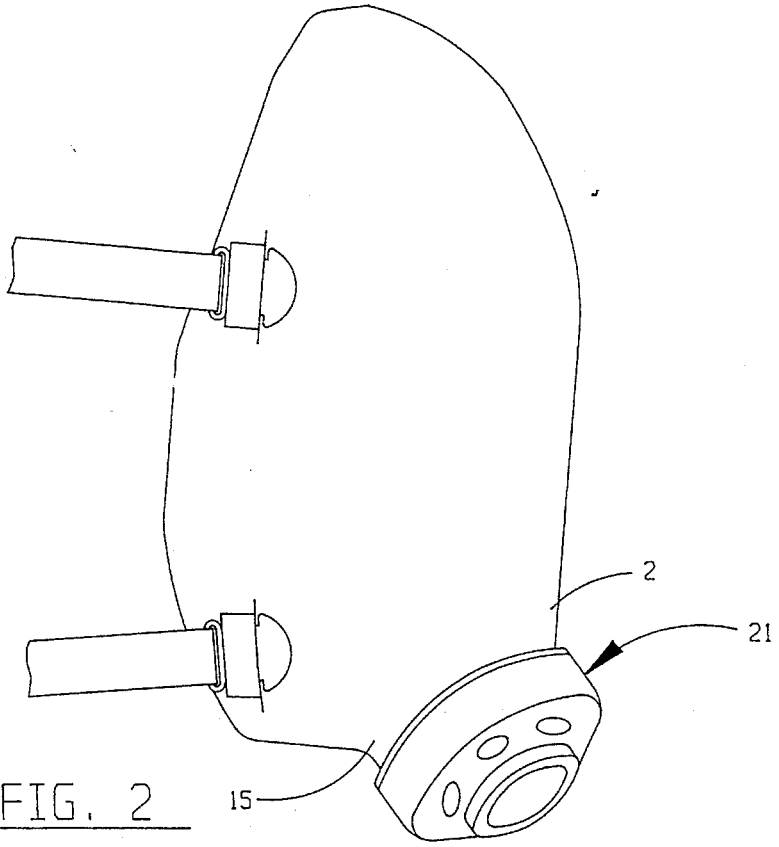
FIG. 2 is a second perspective view of the present invention.
Figure 3:
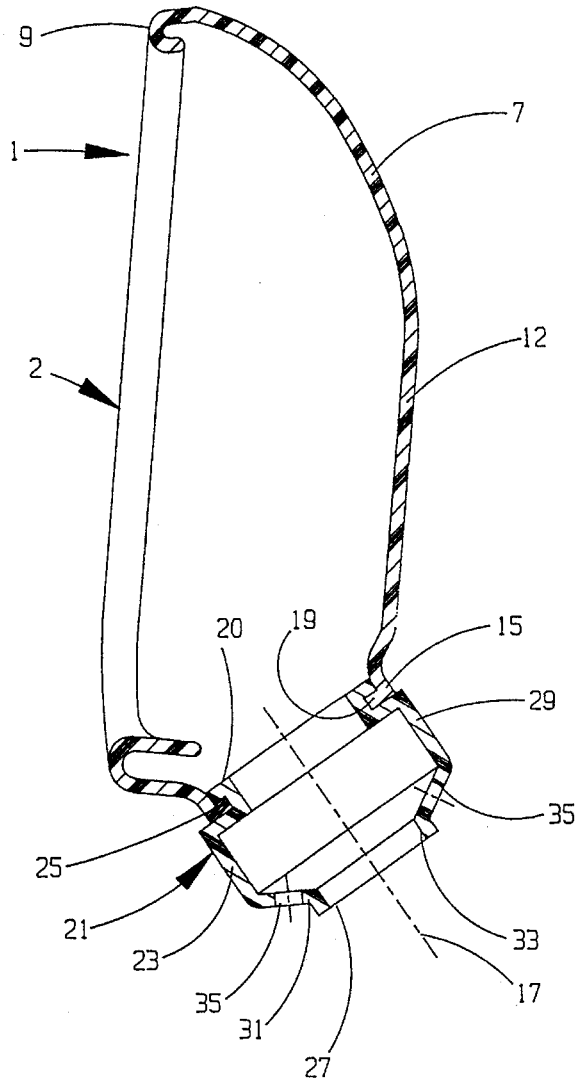
FIG. 3 is a longitudinal cross sectional view of the invention.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–4, a breath controller 1 is illustrated that includes the present invention. The breath controller 1 is particularly useful for keeping the face shield 3 of a helmet 5 free of condensed moisture from a person's breath. However, it will be understood that the invention is not limited to use with protective headgear. Skiers, hunters, joggers, and others who want to control the direction of exhaled breath around their faces also will find the invention highly beneficial.

The breath controller 1 is comprised of a facepiece 6 that includes a shell 7. The shell 7 is made from a plastic or rubber material that stays soft and flexible even in cold weather. The shell 7 has a free edge 9 that is generally pear shaped. For maximum comfort, the shell free edge 9 is a rolled edge. The shell free edge is designed to fit snugly but comfortably around a person's nose, cheeks, and chin. The facepiece 2 is held in place on a person's head by adjustable stretch straps 11 secured to the shell. The shell has a front panel 12 that is spaced forwardly from the person's face. However, there is ample clearance between the shell front panel 12 and the helmet chin protector 13 and face shield 3.

The shell 7 is designed with a short tube 15 in the chin section. The tube 15 defines a longitudinal centerline 17 that makes an angle of approximately 35 degrees with the vertical when the breath controller 1 is in place on a person's face. At the end of the tube is an inturned flange 19.

Held in the shell 7 by means of the tube flange 19 is one end 20 of a hollow sleeve 21. In the illustrated construction, the sleeve 21 has a cylindrical wall 23 with a groove 25 at the first end 20. The groove 25 fits inside the flange 19 of the shell tube 15. The cylindrical wall 23 may extend for the full length of the sleeve to a second end 27. However, I prefer that the cylindrical wall join a frusto-conical wall 31, and that the apex end of the frusto-conical wall forms the sleeve second end 27. In that situation, the frusto-conical wall 31 terminates in a large end opening 33. In the frusto-conical wall are a number of transverse holes 35. The sleeve may be molded from any of a number of rigid plastic materials. The shell tube and the sleeve are designed such that, when a person puts on the breath controller 1 by means of the straps 11, the sleeve end opening 33 and transverse holes 35 are well below the lowermost edge 36 of the helmet 3.

With the breath controller 1 in place on a person's face, he is able to breath freely through the end opening 33 and transverse holes 35 in the sleeve 21. Inhaled and exhaled air, which is confined to the interior of the breath controller, flows directly between the atmosphere and the person's nose and mouth without passing through any intervening components or passages. Because of the location of the sleeve end opening 33 and transverse holes 35 far outside of the helmet, exhaled air never comes in contact with the interior of the helmet or its face shield 13. Consequently, moisture in the person's exhaled breath does not condense on either the helmet or the face shield or the person's glasses, even in the coldest weather. The multiple transverse holes 35 in the sleeve assure that the person can breathe should he tilt his head such that the end opening 33 presses against his clothing on his chest. An important aspect of the invention is that the breath controller is completely separate and independent of the helmet. As a result, the person can put on and remove his helmet without attention to the breath controller. Further, he can put on and remove the helmet using only one hand, which is a great convenience in some situations.

Figure 5:
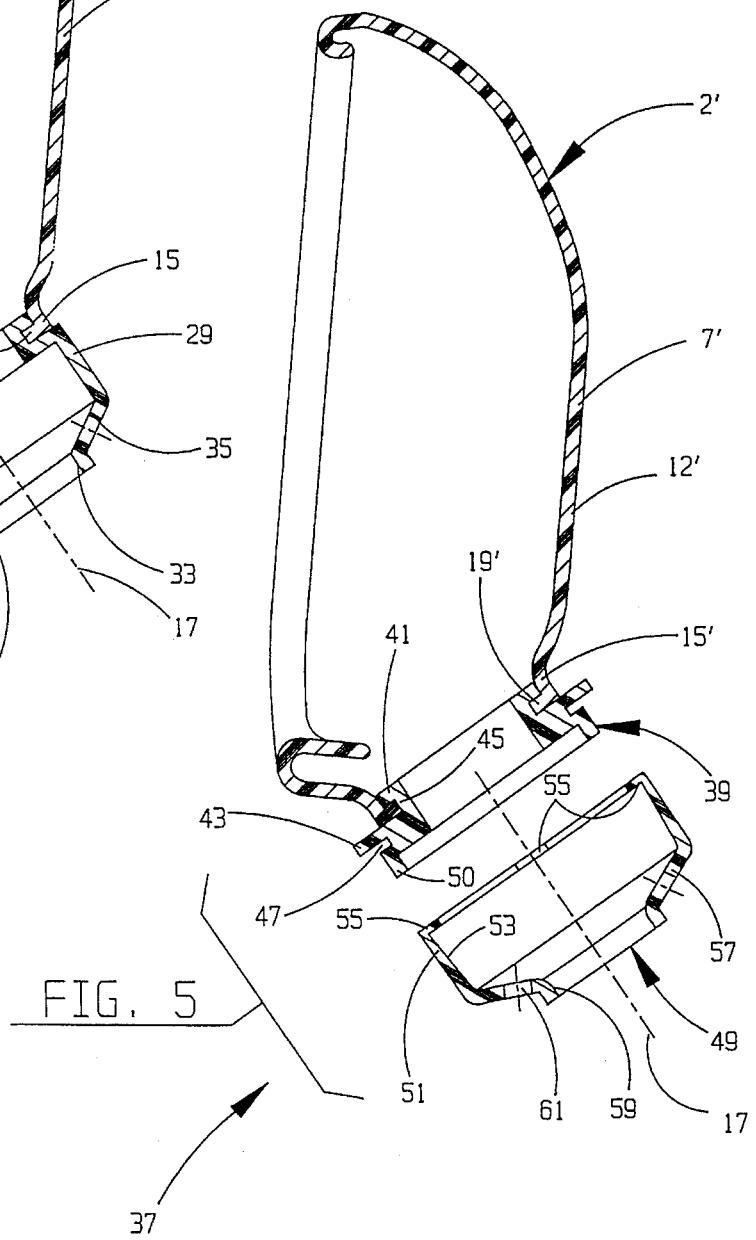
FIG. 5 is a view similar to FIG. 3, but showing an alternate embodiment of the present invention.

Now turning to FIG. 5, an alternate breath controller 37 is shown. The breath controller 37 has a facepiece 2' that is substantially similar to the facepiece 2 described previously in connection with FIGS. 1–4. That is, the facepiece 2' includes a shell 7' having a front panel 12' and a tube 15'. The tube 15' terminates in an inturned flange 19'. One end of a short hollow retainer 39 is held in the tube 15' of the facepiece shell 7'. For that purpose, the retainer 39 has two collars 41 and 43 on opposite sides of a short wall 45. The wall 45 and collars 41 and 43 cooperate to receive the flange 19' of the shell tube 15'. A hub 50 extends from the collar 43. There is a groove 47 in the outer diameter of the collar 43.

Removably attached to the retainer 39 is a hollow cap 49. The cap 49 has a thin and rather resilient cylindrical wall 51. The inner diameter 53 of the cap cylindrical wall 51 is slightly larger than the outer diameter of the retainer hub 50. On one end of the cap cylindrical wall 51 are two or more inturned tabs 55. The other end of the cap cylindrical wall 51 joins a frusto-conical wall 57. The frusto-conical wall 57 terminates in an end opening 59. Several smaller transverse holes 61 are formed in the frusto-conical wall.

Figure 4:
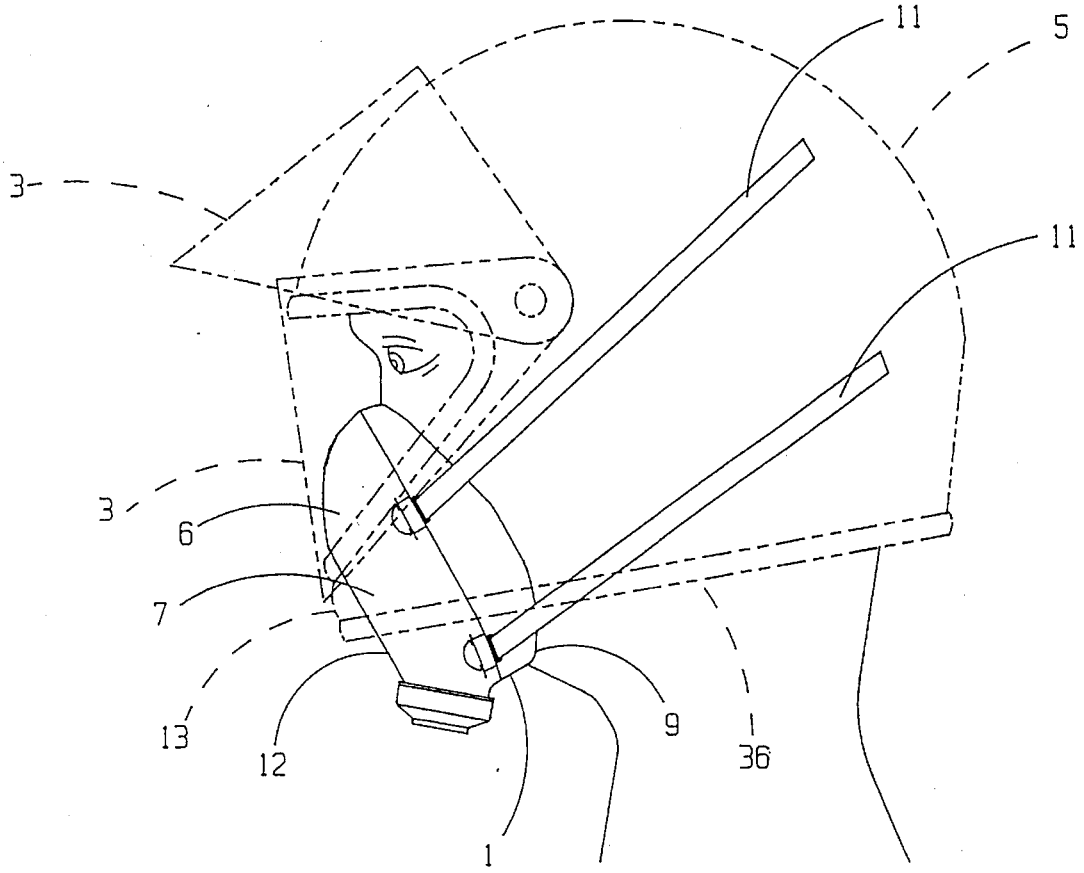
FIG. 4 is a side view of a person wearing the breath controller together with a protective helmet.

The cap 49 is attachable to the retainer 39 by sliding the cap cylindrical wall 51 over the retainer hub 50 until the cap tabs 55 enter the retainer groove 47. The retainer 39 and cap 49 are designed to locate the end opening 59 and transverse holes 61 well below the lowermost edge 36 of a helmet 3 (FIG. 4). To clean the cap from accumulated condensation, it is merely pulled from the retainer; pulling the cap causes its tabs 55 to slide out of the retainer groove 47. In all other respects, the breath controller 37 is used in the same manner as the breath controller 1.

In summary, the results and advantages of protective helmets 5 with face shields 3 can now be more fully realized. The breath controller of the present invention provides both unrestricted breathing for a person as well as control of his breath so moisture in the breath does not fog the face shield or his glasses. This desirable result comes from using the combined functions of the shell 7 and the sleeve 21. The shell and sleeve cooperate to prevent exhaled air from reaching the interior of the helmet or face shield. The sleeve 21 assures that air is inhaled from and exhaled to the atmosphere at a location well outside of the helmet. For easy cleaning, the sleeve may be replaced by the two-piece retainer and cap 39 and 49, respectively.

It will also be recognized that in addition to the superior performance of the breath controller, its design and construction are such as to significantly reduce the cost of manufacture as compared with traditional breathing masks. Also, since the components of the invention are both simple and rugged, the need for maintenance is practically nonexistent.

Thus, it is apparent that there has been provided, in accordance with the invention, a breath controller that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A breath controller adapted for use with a helmet comprising:

a shell made of a flexible material and having a free edge adapted to fit in a substantially air tight fashion over a person's nose, cheeks, and chin while leaving the eyes uncovered, the shell having a chin section and a tube in said chin section of the shell, said shell having only one opening, said tube forming said one opening;

strap means secured to the shell for holding the breath controller to a person's face; and means for directing exhalation outside of said shell and for preventing exhalation from forming condensation inside said shell said directing means comprising:

a sleeve having first and second ends;

groove means at the sleeve first end for holding the sleeve to the shell tube; and wall means joined to the groove means for defining an opening in the sleeve second end and at least one transverse hole intermediate the sleeve first and second ends that is in communication inside the sleeve with the opening in the sleeve second end, the sleeve allowing unrestricted inhaling and exhaling of air through both the opening in the sleeve second end and through the sleeve transverse hole directly between the atmosphere and the person's nose and mouth, the opening in the sleeve second end and the transverse hole being located downwardly and forwardly of the chin section of said shell and adapted to extend substantially below the lowermost edge of a helmet worn by a person.

2. In combination, a helmet having a lower edge and a face shield, and a breath controller having means for preventing moisture in exhaled breath from fogging the face shield, said breath controller comprising:

a. a facepiece formed as a shell having a free edge adapted to fit over a person's nose, cheeks, and chin and that leaves the eyes uncovered, said shell defining a chin section;

b. strap means for holding the facepiece in position; and c. said means for preventing fogging comprising a sleeve defining the sole opening into said shell for inhalation and exhalation and having a first end held to the shell in the chin section of said shell and a second end that terminates substantially below the helmet lower edge, the sleeve defining an unrestricted opening at the second end thereof and a plurality of unrestricted transverse holes intermediate the first and second ends thereof, the transverse holes being in communication inside the sleeve with the opening at the sleeve second end, the sleeve opening at the second end thereof and the transverse holes being located at respective locations substantially below the helmet lower edge to thereby enable inhalation and exhalation directly to atmosphere through both the opening in the sleeve second end and through the sleeve transverse holes and avoid fogging the helmet face shield.

* * * * *